US005274323A

United States Patent [19]

Dobkin et al.

[11] Patent Number: 5,274,323

[45] Date of Patent: Dec. 28, 1993

[54] CONTROL CIRCUIT FOR LOW DROPOUT REGULATOR

[75] Inventors: Robert C. Dobkin, Monte Sereno; Carl T. Nelson, San Jose; Dennis P. O'Neill, San Carlos, all of Calif.

[73] Assignee: Linear Technology Corporation, Milpitas, Calif.

[21] Appl. No.: 785,483

[22] Filed: Oct. 31, 1991

[51] Int. Cl.[5] ..... G05F 1/575

[52] U.S. Cl. ..... 323/280; 323/273; 323/281

[58] Field of Search ..... 323/273, 277, 280, 281

[56] References Cited

U.S. PATENT DOCUMENTS

| | | | |
|---|---|---|---|
| 4,543,522 | 9/1985 | Moreau | 323/274 |
| 4,613,809 | 9/1986 | Skovmand | 323/268 |
| 4,779,037 | 10/1988 | Lo Cascio | 323/281 |
| 4,792,745 | 12/1988 | Dobkin et al. | 323/274 |
| 4,792,747 | 12/1988 | Schroeder | 323/274 |
| 4,851,953 | 7/1989 | O'Neill et al. | 323/277 |
| 4,906,913 | 3/1990 | Stanojevic | 323/273 |
| 4,926,109 | 5/1990 | Koterasawa | 323/273 |
| 4,928,056 | 5/1990 | Pease | 323/314 |
| 5,036,269 | 7/1991 | Murari et al. | 323/275 |
| 5,041,777 | 8/1991 | Riedger | 323/277 |

*Primary Examiner*—Jeffrey Sterrett

*Attorney, Agent, or Firm*—Mark D. Rowland; Robert W. Morris

[57] ABSTRACT

A three terminal control circuit for a low dropout voltage regulator having a PNP pass transistor is provided. The control circuit is capable of pulling the base drive point down to a voltage of 3.0 volts or less to permit a current limiting resistor to be inserted between the base drive point and the base of the PNP pass transistor. The control circuit includes a pair of small-valued capacitors for providing stable operation with different output capacitors. The control circuit can also be used with p-channel FET pass transistors.

42 Claims, 3 Drawing Sheets

CONTROL CIRCUIT FOR LOW DROPOUT REGULATOR

BACKGROUND OF THE INVENTION

The present invention relates to a control circuit for providing low dropout voltage regulation in a series voltage regulator circuit. More particularly, the present invention relates to a three terminal control circuit for driving a discrete PNP transistor or p-channel FET to provide a low dropout positive series voltage regulator circuit.

A series voltage regulator circuit requires a minimum voltage differential between the supply voltage and the regulated output voltage in order to provide proper regulation. This minimum voltage differential is known as the dropout voltage of the regulator circuit. A voltage regulator circuit having a low dropout voltage has many useful applications.

Three terminal integrated circuit (IC) control devices for PNP regulators are usually designed with the intention that the base drive terminal be connected directly to the base of the discrete PNP transistor. This maximizes the voltage available for powering circuitry in the device which must use the base drive terminal as a power supply. Accordingly, the circuits generally are not designed to pull the voltage of the base drive terminal more than one volt below the regulator input voltage.

In some regulator applications, it may be desirable to use an FET as the pass transistor. However, such applications may require that the gate voltage of the FET be pulled down close to ground (e.g. to create a gate-source voltage differential of several volts). Conventional regulator control circuits are not designed to operate in this manner, as discussed above.

With a three terminal IC control circuit design (for a PNP regulator), the output current and input voltage of the regulator cannot be sensed for purposes of current limiting. This is because either type of sensing would require additional terminals. Thus, the current limit point of the IC's internal base drive current limit circuitry must be set based on the anticipated current gain of the discrete transistor, and the anticipated regulator output current, to avoid regulator operating conditions exceeding the current and power handling limits of the discrete PNP transistor.

However, protection becomes unpredictable if the user chooses a discrete PNP transistor having different current gain and power handling characteristics than those anticipated by the manufacturer. For example, the user may select a PNP transistor that cannot be safely operated at the maximum base drive current allowed by the internal current limit circuitry of the control circuit.

A similar problem arises with respect to frequency compensation. An IC regulator control circuit may be used in various application circuits having output capacitors of widely different capacitance and effective series resistance (ESR) values. However, the frequency compensation circuitry of conventional IC regulator control circuits generally provides stability only for a limited range of output capacitors.

Accordingly, it would be desirable to be able to provide a three terminal voltage regulator control circuit which could be used in a low dropout regulator circuit design in which current limiting could be adjusted for different PNP pass transistors and different applications. It would further be desirable if the control circuit could tolerate a wide range of output capacitors, and if the control circuit could provide several volts of gate-source drive voltage for an FET pass transistor in a low voltage circuit.

SUMMARY OF THE INVENTION

It is therefore an object of this invention to provide a three terminal control circuit for driving a PNP pass transistor in a regulator circuit having a low dropout voltage and controllable current limiting.

It is another object of this invention to provide a frequency compensation circuit that can be incorporated in a regulator control circuit to provide stability in conjunction with different sized regulator circuit output capacitors.

It is yet another object of this invention to provide a three terminal regulator control circuit that can drive a p-channel FET pass transistor in a circuit where the source voltage is limited to a low input voltage.

These and other objects are accomplished by a control circuit that can be implemented in an integrated circuit package having three terminals: a base drive terminal, a feedback terminal and a ground terminal. The control circuit is designed to saturate at a base drive terminal voltage of less than three volts, preferably going as low as 1.1 volts under some low current conditions, such that a resistor can be inserted between the base drive terminal and the PNP transistor base to limit regulator output current and to limit power dissipation in the control circuit, and such that a p-channel FET can be used as the pass transistor.

The control circuit also includes a frequency compensation circuit that can be implemented without a large value internal capacitor, and that provides stability in regulator circuits having different output capacitors.

BRIEF DESCRIPTION OF THE DRAWING

The above and other objects and advantages of the present invention will be apparent upon consideration of the following detailed description, taken in conjunction with the accompanying drawings, in which like reference characters are provided to like characters throughout, and in which.

DETAILED DESCRIPTION OF THE INVENTION

Figure 1:
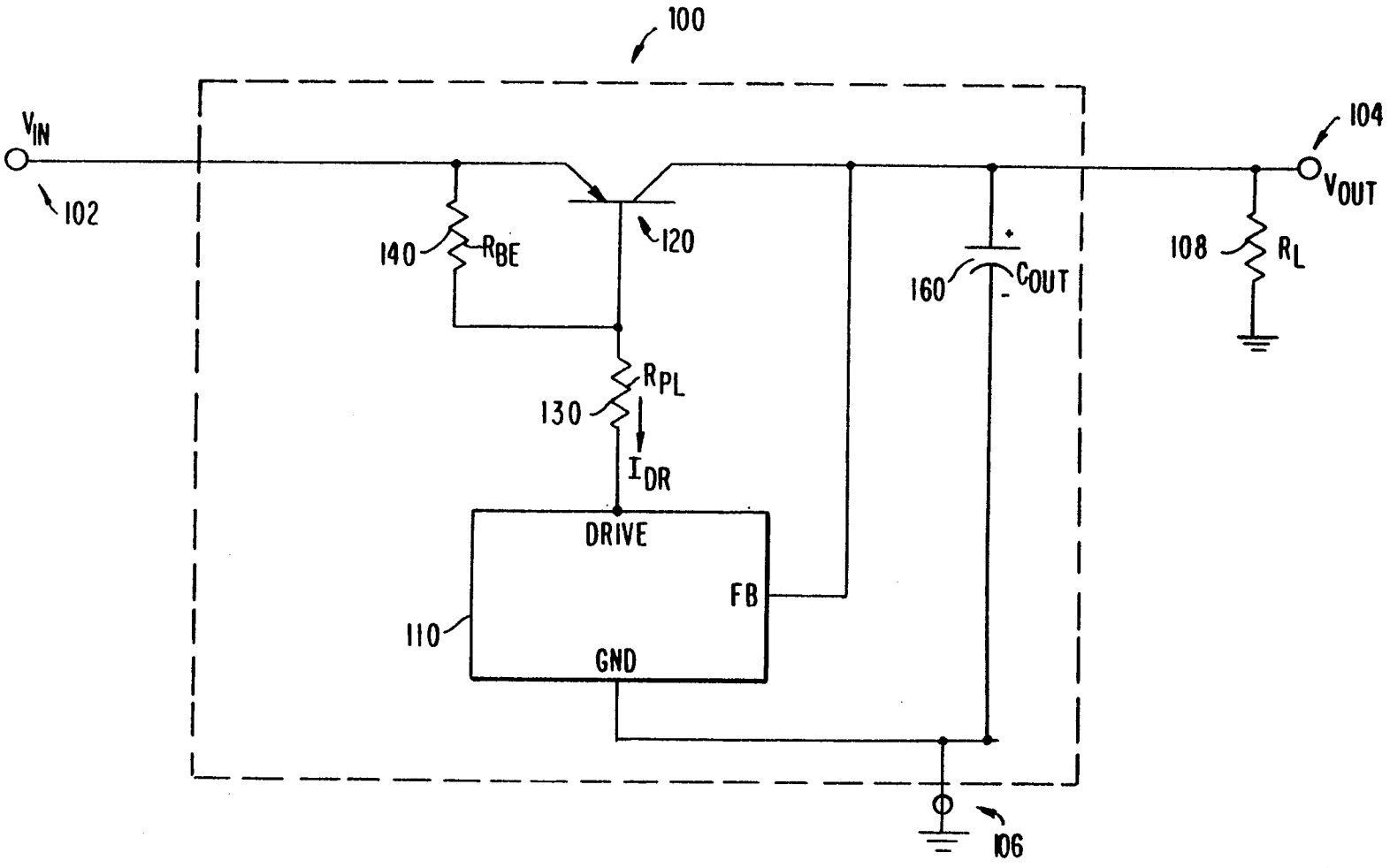
FIG. 1 shows a schematic diagram of an application circuit for a control circuit designed in accordance with the principles of the present invention.

FIG. 1 illustrates an exemplary application circuit 100 for a voltage regulator control circuit of the type contemplated for the present invention. Application circuit 100 is configured as a positive series voltage regulator circuit. When an unregulated positive input voltage $V_{IN}$ is applied to voltage input node 102 (positive with respect to the voltage at ground node 106), voltage regulator circuit 100 provides a regulated positive output voltage $V_{OUT}$ (also positive with respect to the voltage at ground node 106 to a load connected to voltage output node 104. In FIG. 1, a simple resistive load $R_L$ is represented by resistor 108.

Control circuit 110, which is preferably a monolithic integrated circuit device, has three terminals labeled as DRIVE (base drive), FB (feedback) and GND (ground). In FIG. 1, control circuit 110 together with a discrete PNP transistor 120, a current limiting resistor 130, a pull-up resistor 140 and an output capacitor 160, form voltage regulator circuit 100. Control circuit 110 regulates the output voltage $V_{OUT}$ which it senses at its feedback terminal FB, by controlling the base current of PNP transistor 120 to maintain the voltage at terminal FB of the control circuit at a predetermined voltage. With the exception of current limiting resistor 130, the configuration of voltage regulator circuit 100 is conventional.

Current limiting resistor 130, which is optional, provides a controlled limit on the base drive current of PNP transistor 120 that can be adjusted for different input voltages and different PNP transistors. The value of resistor 130 can be selected to provide a desired current limit value for a given input voltage. For example, assume that output voltage $V_{OUT}$ suddenly falls below the value at which it is being regulated by regulator circuit 100 due to an overload condition. Control circuit 11 will attempt to turn PNP transistor 120 on hard by sinking a large base drive current $I_{DR}$ at its DRIVE terminal. This current will generate a voltage across resistor 130. As the base drive current increases, a point will be reached at which the voltage across resistor 130 drives control circuit 110 into saturation. The base drive current will be limited by the saturation of the control circuit.

Assuming the saturation voltage of control circuit 110 and the forward base-emitter voltage drop of PNP transistor 120 sum to approximately 2.0 volts, a value of current limiting resistor 130 can easily be chosen to provide a desired base drive current $I_{DR}$ by the following formula $R_{PL}=(V_{MIN}-2.0\ V)I_{DR}$, where $V_{MIN}$ is the minimum expected input voltage.

Conventional regulator control circuits are designed with the intention that the DRIVE terminal operate at a voltage within approximately one volt of the regulator input voltage. Such designs generally do not permit a current limiting resistor, other than perhaps a very small value resistor, to be used as shown in FIG. 1 without substantially increasing the dropout voltage of the regulator.

Applicants have conceived of a design for the circuitry of control circuit 110 that permits the DRIVE terminal to saturate at voltages as low as approximately 1.1 volts above ground. This allows a wide range of current limiting resistors (e.g. 20–110 ohms) to be inserted between the DRIVE terminal and the base of the PNP transistor while maintaining a low dropout voltage. Although applicants prefer such a low saturation voltage, applicants believe that effective current limiting (i.e. current limiting that avoids catastrophic PNP transistor damage under high input voltage and short circuit output conditions) can be achieved with somewhat higher saturation voltages. For example, applicants contemplate that current limiting in accordance with the principles of the present invention could be accomplished in a 5 volt regulator with a control circuit having a saturation voltage as high as 3 volts.

In another aspect, the present invention features a frequency compensation circuit that can be implemented in the control circuit to provide stability when the control circuit is used with different output capacitors. This is accomplished by providing a combination feedback and feedforward scheme involving a pair of small-valued capacitors that cause the regulator loop gain to roll off to a point well below 0 dB before flattening out at higher frequencies. The circuit thus allows sufficient phase and gain margin to tolerate a wide range of output capacitors.

Figure 2:
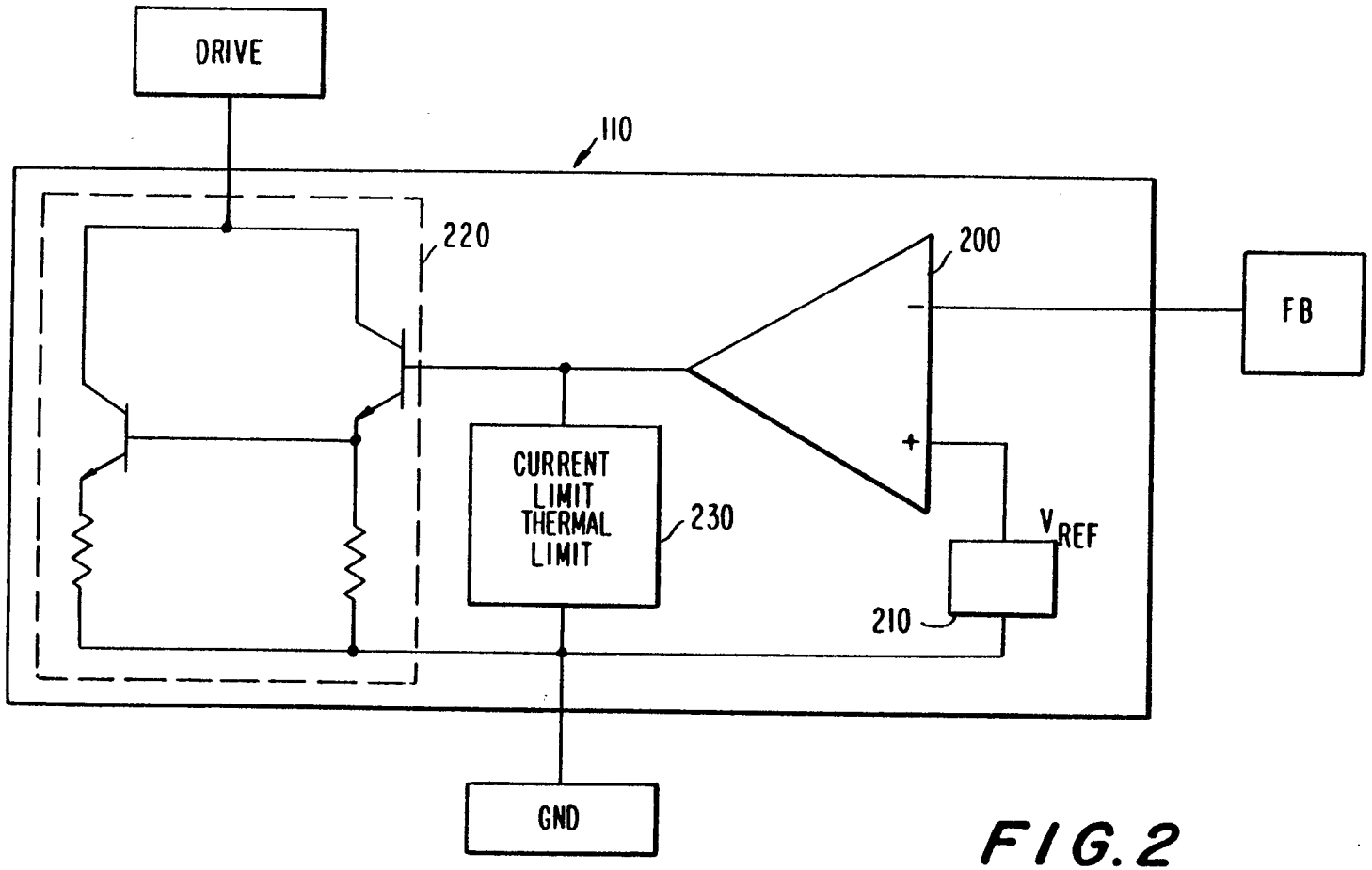
FIG. 2 shows a simplified block diagram of an embodiment of the control circuit of the present invention.

FIG. 2 illustrates, in block diagram form, an exemplary control circuit architecture suitable for incorporating the present invention in control circuit 110. Control circuit 110 includes an error amplifier circuit 200 having an inverting input connected to the feedback terminal FB, and a non-inverting input connected to a voltage reference circuit 210. Error amplifier circuit 200 compares the voltage of terminal FB with a fixed voltage generated by reference circuit 210, and provides an error signal to driver circuit 220. This error signal controls driver circuit 220, which, responsive to the error signal, conducts base drive current between the DRIVE and GND terminals of control circuit 110. Control circuit 110 also includes an internal base drive current limit circuit 230 that limits the current conducted by driver circuit 220 to a predetermined value, and that turns off driver circuit 220 if the operating temperature of control circuit 110 exceeds a threshold temperature.

Figure 3:
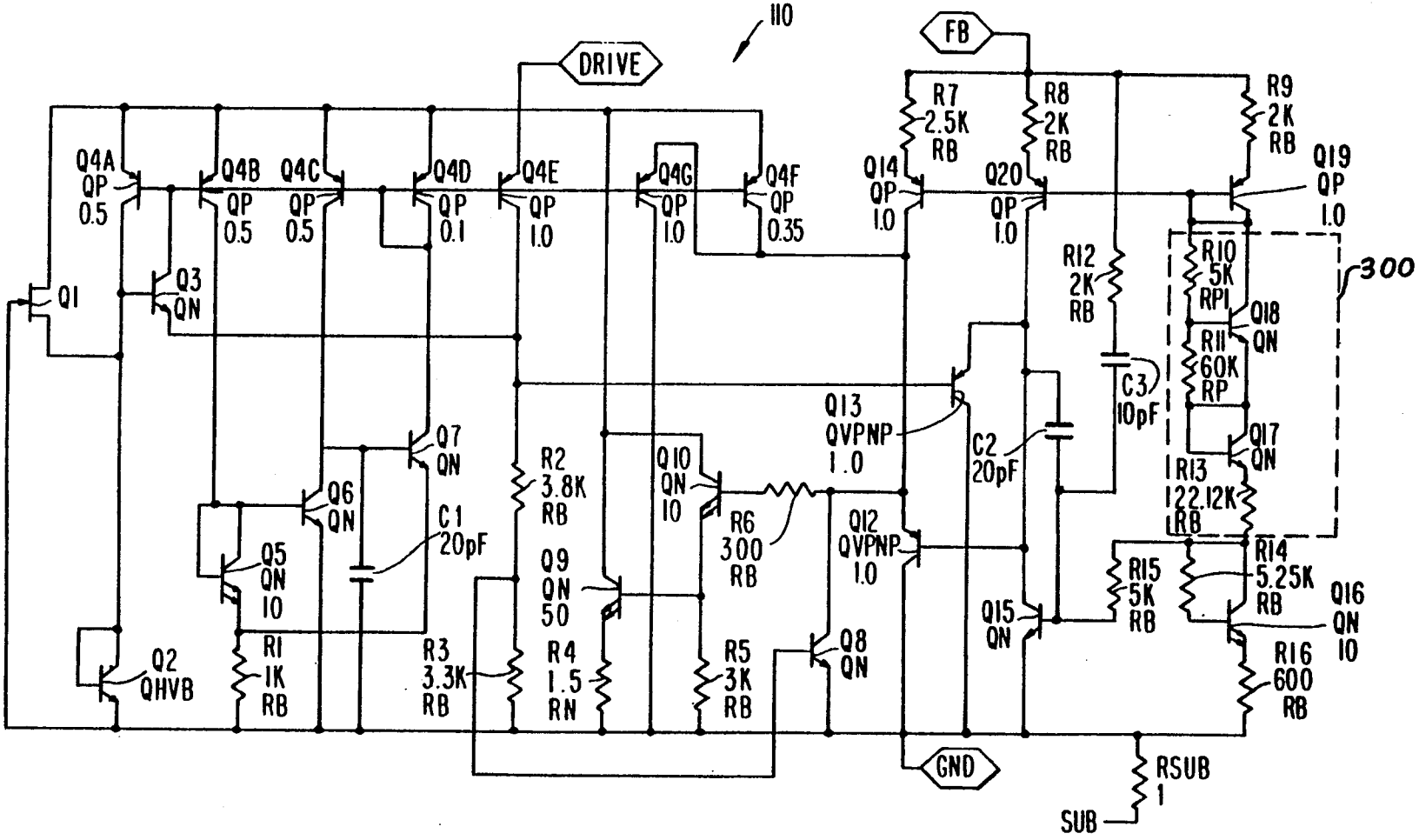
FIG. 3 shows a schematic diagram of a preferred circuit embodiment of the control circuit of the present invention.

FIG. 3 illustrates a preferred circuit embodiment for implementing the control circuit 110 of the present invention in an integrated circuit device having the general architecture of FIG. 2. This particular embodiment is designed to provide a regulated output voltage of approximately 5 volts. The circuit generally comprises three sections: a start-up section, a bias section, and a control section.

The purpose of the start-up section is to start control circuit 110 working when a voltage differential first appears across the DRIVE and GND terminals. The start-up section includes transistors Q1, Q2, Q3 and Q4A on the left hand side of FIG. 3. Transistor Q1 is a JFET produced by epitaxial growth and serves the purpose of providing current to diode-connected transistor Q2 when a voltage differential appears across the DRIVE and GND terminals. Transistor Q2 is fabricated to have a high turn-on voltage ($V_{BE}$ approximately 850 mV at 25 degrees Celsius). With a small current flowing through transistor Q2, transistor Q3 then turns on and subsequently sends current through resistors R2 and R3 while simultaneously drawing current from the common base node of transistors Q4A–G. This causes transistors Q4A–F, all of which have their base-emitter circuits connected in parallel, to turn on. The turning on of transistor Q4E causes additional current flow through resistors R2 and R3. This additional current increases the voltage at the emitter of transistor Q3 (i.e., across resistors R2 and R3) so as to eventually reverse bias the base-emitter junction of Q3 and therefore shut off the start-up circuit from the rest of the circuit after the Q4A–F transistors have been turned on. Once control circuit 110 is operating, the components in the start-up section are of no consequence.

Moving further to the right of FIG. 3, transistors Q5, Q6 and Q7 form the bias section. These transistors bias the PNP transistor string Q4A–G to provide substantially constant current from all the PNP collectors even with changing output/drive voltage. This substantially constant current is also used to generate a substantially constant reference voltage across resistors R2 and R3.

The bias section can operate down to approximately one volt. Transistors Q5 and Q6, which are connected in a current mirror configuration, have unequal emitter areas in a ratio 10:1, causing a d($V_{BE}$) voltage of approximately 60 mV to appear across resistor R1 when transistors Q5 and Q6 conduct equal currents. This voltage, which sets the current in the bias transistors Q4B–F, has a positive temperature coefficient. Transistor Q7 is connected to provide a feedback loop. This feedback loop ensures a substantially constant current with changing voltage at the DRIVE terminal. Capacitor C1 is provided as frequency compensation for the feedback loop.

The control section of control circuit 110 is of a bandgap-reference type and comprises a combined reference voltage generator and error amplifier circuit (corresponding to blocks 200 and 210 of FIG. 2) which drives a current gain stage (corresponding to driver circuit block 220 of FIG. 2). More particularly, transistors Q15–20 on the right hand side of FIG. 3 form the active components of the bandgap circuit. The output of this bandgap-type circuit drives current gain stage transistors Q12, Q9 and Q10, which in turn drive the base drive point (the DRIVE terminal) of the control circuit.

The bandgap circuit of FIG. 3 is powered by current drawn from the feedback terminal (FB) of control circuit 110. As is well-known, and will therefore only be briefly discussed here, a bandgap circuit works by balancing positive and negative temperature coefficients to provide a temperature-stable reference voltage. In the circuit of FIG. 3, when voltage is applied to the FB terminal, current flows through the transistor/resistor string R9, Q19 (diode-connected), Q18 (and its associated bias resistor R10 and R11), Q17 (diode-connected), R13, Q16 and R15. By virtue of the current mirror configuration of transistors Q19 and Q20, an equal current also flows through resistor R8 and transistor Q20. The currents through transistors Q19 and Q20, and hence the voltages across resistors R9, R13 and R16, have positive temperature coefficients, which are offset by the negative temperature coefficients of the base-emitter voltages of transistors Q16–Q19.

Transistors Q15 and Q20 act as an error amplifier, the output of which is an error signal appearing at the collector of transistor Q15. The voltage at this node is clamped by transistor Q13 for current limit protection, as discussed below.

As the voltage at the feedback terminal rises, the currents flowing through the transistor/resistor string R9, Q19, Q18, Q17, R13, Q16, R16, and through resistor R8 and transistor Q20, increase in equal amounts. However, as current increases the d($V_{BE}$) voltage generated across resistor R16 causes the current ratio between transistors Q16 and Q15 to decrease, such that the collector voltage of transistor Q15, which is initially high, begins to decrease. When the voltage drop across resistor R16 reaches approximately 60 mV, the current ratio between transistors Q15 and Q16 becomes approximately 1:1. Control circuit 110 is designed to regulate at this point, which equates to a voltage of 5 volts on the feedback terminal.

The voltage at the collector of transistor Q15 drives the current gain stage formed by transistors Q12, Q9 and Q10 and bias resistors R4, R5 and R6. Transistor Q12, which receives operating current from transistors Q14 and Q4F, acts as an emitter-follower buffer. When the voltage at the feedback terminal is less than 5 volts, the collector voltage of transistor Q15 holds the base and emitter voltages of transistor Q12 high, which in turn causes output drive transistors Q9 and Q10 to sink current from the DRIVE terminal. When thus driven, output drive transistors Q9 and Q10 are capable of pulling the voltage at the DRIVE terminal down to less than 1.5 volts at a drive current level of 10 mA. This saturation voltage rises to approximately 2.0 volts at a drive current of 150 mA. Thus, an external current limiting resistor can be inserted between the DRIVE terminal of control circuit 110 and the base of the discrete PNP transistor to limit base drive current without increasing the dropout voltage of the regulator circuit. The value of this resistor can be selected as previously discussed.

For example, assuming the base-emitter voltage of the discrete PNP transistor to be 0.9 V and the regulator input voltage to be just above 5 volts (thus taking into account the voltage drop required across the emitter-collector of the PNP transistor), a 20 ohm resistor can be used to force the control circuit into saturation at a base drive current of 150 mA. For higher input voltages, the same current limit value can be achieved with a greater resistance value.

If the voltage at the feedback terminal rises above 5.0 volts, the voltage at the collector of transistor Q15 swings downward, thus reducing the drive signal provided to transistors Q9 and Q10 and causing the control circuit to sink less base drive current from the DRIVE terminal. Control circuit 110 can be modified easily to regulate at voltages other than 5 volts. Applicants contemplate that the circuit architecture of FIG. 3 can be used to regulate positive voltages in the range from about 15 volts down to about 2.5 volts with only minor changes to the basic architecture of the circuit. This range of regulation is achieved by tailoring the I/V characteristics of transistors Q17 and Q18 and resistors R10, R11 and R13. These elements can be viewed collectively as comprising an adjustable regulation impedance component 300 (as shown in FIG. 3) which serves the purpose of setting the desired regulation voltage. To lower the regulation voltage, for example, one or both of transistors Q17 and Q18 can be removed, bias resistors R10 and R11 (which increase the voltage drop across transistor Q18) can be removed or changed, and/or the resistance value of resistor R13 can be lowered.

Regulation impedance component 300 can be simply a resistor or a combination of resistors, transistors and diodes or the like, chosen so that the voltage drop across it produces the proper desired regulation voltage. However, it should be borne in mind that, when selecting the particular elements which make up regulation impedance component 300, the temperature drift of the circuit may be affected. The selection of the combination of components should be such that the desired temperature drift of the control circuitry (typically zero) is obtained at the desired regulation voltage.

It should also be noted that, for lower regulation voltages (e.g. 2.85 volts), a start-up problem may be encountered due to the base voltage of Q12 being held low by the parasitic collector-base diode of transistor Q20, which can be pulled low through the resistor/transistor string including transistor Q19. To avoid this problem, circuitry powered from the DRIVE terminal can be incorporated to provide current to the base and emitter of transistor Q12 at start-up, thereby allowing transistors Q9 and Q10 to be turned on.

Control circuit 110 further includes a frequency compensation circuit which provides stable operation for a wide range of output capacitors (e.g., capacitors equal to or greater than 10 microfarads). The frequency compensation circuit comprises a pair of small value capacitors C2 and C3 whose values are selected to provide a roll-off of gain to well below 0dB (e.g., to 6db below unity), which roll-off then flattens out at higher frequencies. This allows the circuit to accommodate various amounts of output capacitance and ESR values. Capacitor C2 provides a −6dB/octave rolloff in the gain of the amplifier output at the collector of transistor Q15. Resistor R15 combines with capacitor C2 to set the pole frequency of capacitor C2 (resistor R14 is added to balance the base current of transistor Q16 to compensate for the presence of resistor R15), and capacitor C3 provides a zero. This zero cancels the pole generated by capacitor C2 at a frequency which allows the regulator loop gain to fall well below unity. This provides phase margin to allow for a wide range of output capacitors. The zero frequency is determined by the capacitance of capacitor C3, the impedance of component 300, and the resistances of resistors R15 and R16. Appropriate values for capacitors C2 and C3 can be determined empirically. Resistor R12 has been added to provide ESD protection for capacitor C3.

A few other aspects of control circuit 110 are notable. Referring again to transistor Q4F, this transistor assists in start-up of the control circuit. At start-up, transistor Q14 does not provide current (assuming the voltage of feedback terminal FB to be low). Transistor Q4F, which is powered by the DRIVE terminal, is therefore provided to supply current to the base of output drive transistor Q10 so as to begin to drive the external PNP pass transistor. Transistor Q14 could be eliminated from the circuit. However, it provides an additional current limit foldback feature. If the output of the regulator shorts to ground, transistor Q14 will be turned off. During normal operation, this transistor provides approximately three-fourths (75 microamps) of the operating current for transistors Q10 and Q12. Thus, the output short causes the available drive current for transistor Q10 to be decreased dramatically, thus effectively folding back the internal current limit of the control circuit.

Transistor Q4G serves the purpose of a clamp and keeps transistor Q4F from saturating, which would disturb the bias levels in the other PNP transistors in the bias string. Resistor R6 is added to the output drive stage to prevent high frequency oscillations. Transistor Q13 provides an internal current limit, which works as follows. The base-emitter junction of transistor Q13 is normally reverse-biased for small currents in transistors Q9 and Q10 because the voltage across resistors R2 and R3 is higher than the voltage at the base of transistor Q12 which is connected to the emitter of transistor Q13. However, for larger currents the base-emitter junction of transistor Q13 becomes forward biased and thus turns transistor Q13 on causing current which would normally force the base of transistor Q12 high to be sent to ground through the collector of transistor Q13, thus producing clamping action. The internal current limit value is set by the value of resistor R4. In the embodiment of FIG. 3, the internal current limit circuitry limits the current at the DRIVE terminal to approximately 170 mA.

Thermal protection is provided by transistor Q8, which draws current away from the base of transistor Q1O if a threshold temperature is exceeded. The voltage at the base of transistor Q8 has a positive temperature coefficient. The base-emitter junction of transistor Q8 has a negative temperature coefficient. Transistor Q8 turns on at a temperature of approximately 165 degrees Celsius.

Thus, a novel control circuit for a voltage regulator is provided. Persons skilled in the art will appreciate that the present invention can be practiced by other than the described embodiments, and that in actual circuits various additional components and alternative interconnections not shown in the figures may be used. The described embodiments are presented for the purposes of illustration and not of limitation, and the present invention is limited only by the claims which follow.

What is claimed is:

1. An integrated circuit for controlling a discrete series-pass voltage regulator transistor coupled between an input voltage source and a load, the integrated circuit comprising:

a first terminal adapted for (1) receiving an operating voltage for the integrated circuit, and (2) providing a drive signal for controlling the voltage drop across the discrete transistor to cause the transistor to regulate the voltage at the load to provide a regulated voltage;

a second terminal adapted for monitoring the voltage at the load;

a ground terminal; and a control means coupled to said terminals and operable for generating the drive signal responsive to the monitored voltage to maintain the load substantially at the regulated voltage when the drive terminal operating voltage is less than the voltage at the load.

2. The circuit of claim 1, wherein the control means is operable for generating the drive signal responsive to the monitored voltage to maintain the load substantially at the regulated voltage when the drive terminal operating voltage is less than 2.0 volts above the voltage of the ground terminal.

3. The circuit of claim 2, wherein the control means is operable for generating the drive signal responsive to the monitored voltage to maintain the load substantially at the regulated voltage when the drive terminal operating voltage is less than 1.5 volts above the voltage of the ground terminal.

4. The circuit of claim 3, wherein the control means is operable for generating the drive signal responsive to the monitored voltage to maintain the load substantially at the regulated voltage when the drive terminal operating voltage is less than 3.0 volts above the voltage of the ground terminal.

5. The circuit of claim 4 wherein the circuit includes:

bias circuit means for generating substantially constant bias currents for the circuit, wherein the bias circuit means is powered by the operating voltage and regulates the bias currents over a range of operating voltages.

6. The circuit of claim 5, wherein the circuit includes:

means for generating an error signal indicative of a difference between the voltage at the load and the regulated voltage, the error signal generating means being powered by the load voltage; and current gain means for generating the drive signal responsive to the generated error signal.

7. The circuit of claim 6, wherein the circuit includes:

start-up means for drawing current from the drive terminal to turn on the bias means, wherein the start-up means is powered by the operating voltage.

8. The circuit of claim 6, wherein the error signal generating means comprises an error amplifier circuit and the current gain means comprises two cascaded emitter follower NPN transistors, wherein the emitter of one of the NPN transistors drives the base of the other NPN transistor.

9. The circuit of claim 4, wherein the circuit includes a current limit means for limiting the series-pass voltage regulator transistor output current delivered to the load, said current limit means limiting the current through the drive terminal to a first amount so as to limit the series-pass voltage regulator transistor output current to a second amount.

10. The circuit of claim 9, wherein the current limit means monitors drive terminal current so as to limit the drive terminal current when it reaches the first amount.

11. The circuit of claim 3 wherein the circuit includes:

bias circuit means for generating substantially constant bias currents for the circuit, wherein the bias circuit means is powered by the operating voltage and regulates the bias currents over a range of operating voltages.

12. The circuit of claim 11, wherein the circuit includes:

means for generating an error signal indicative of a difference between the voltage at the load and the regulated voltage, the error signal generating means being powered by the load voltage; and current gain means for generating the drive signal responsive to the generated error signal.

13. The circuit of claim 12 wherein the circuit includes:

start-up means for drawing current from the drive terminal to turn on the bias means, wherein the start-up means is powered by the operating voltage.

14. The circuit of claim 12, wherein the error signal generating means comprises an error amplifier circuit and the current gain means comprises two cascaded emitter follower NPN transistors, wherein the emitter of one of the NPN transistors drives the base of the other NPN transistor.

15. The circuit of claim 3, wherein the circuit includes a current limit means for limiting the series-pass voltage regulator transistor output current delivered to the load, said current limit means limiting the current through the drive terminal to a first amount so as to limit the series-pass voltage regulator transistor output current to a second amount.

16. The circuit of claim 15, wherein the current limit means monitors drive terminal current so as to limit the drive terminal current when it reaches the first amount.

17. The circuit of claim 3 wherein the regulated voltage is approximately 2.7 to 3.0 volts and the discrete series-pass voltage regulator transistor is a PNP bipolar transistor.

18. The circuit of claim 3 wherein the regulated voltage is approximately 4.9 to 5.1 volts and the discrete series-pass voltage regulator transistor is a PNP bipolar transistor.

19. The circuit of claim 2 wherein the circuit includes:

bias circuit means for generating substantially constant bias currents for the circuit, wherein the bias circuit means is powered by the operating voltage and regulates the bias currents over a range of operating voltages.

20. The circuit of claim 19, wherein the circuit includes:

means for generating an error signal indicative of a difference between the voltage at the load and the regulated voltage, the error signal generating means being powered by the load voltage; and current gain means for generating the drive signal responsive to the generated error signal.

21. The circuit of claim 20, wherein the circuit includes:

start-up means for drawing current from the drive terminal to turn on the bias means, wherein the start-up means is powered by the operating voltage.

22. The circuit of claim 20, wherein the error signal generating means comprises an error amplifier circuit and the current gain means comprises two cascaded emitter follower NPN transistors, wherein the emitter of one of the NPN transistors drives the base of the other NPN transistor.

23. The circuit of claim 2, wherein the circuit includes a current limit means for limiting the series-pass voltage regulator transistor output current delivered to the load, said current limit means limiting drive terminal current to a first amount so as to limit the series-pass voltage regulator transistor output current to a second amount.

24. The circuit of claim 23, wherein the current limit means monitors drive terminal current so as to limit the drive terminal current when it reaches the first amount.

25. The circuit of claim 2 wherein the regulated voltage is approximately 4.9 to 5.1 volts and the discrete series-pass voltage regulator transistor is a PNP bipolar transistor.

26. The circuit of claim 2 wherein the regulated voltage is approximately 2.7 to 3.0 volts and the discrete series-pass voltage regulator transistor is a PNP bipolar transistor.

27. The circuit of claim 1 wherein the circuit includes:

bias circuit means for generating substantially constant bias currents for the circuit, wherein the bias circuit means is powered by the operating voltage and regulates the bias currents over a range of operating voltages.

28. The circuit of claim 27, wherein the circuit includes:

means for generating an error signal indicative of a difference between the voltage at the load and the regulated voltage, the error signal generating means being powered by the load voltage; and current gain means for generating the drive signal responsive to the generated error signal.

29. The circuit of claim 28, wherein the error signal generating means comprises an error amplifier circuit and the current gain means comprises two cascaded emitter follower NPN transistors, wherein the emitter of one of the NPN transistors drives the base of the other NPN transistor.

30. The circuit of claim 28 wherein the circuit includes:

start-up means for drawing current from the drive terminal to turn on the bias means, wherein the start-up means is powered by the operating voltage.

31. The circuit of claim 1, wherein the circuit includes a current limit means for limiting the series-pass voltage regulator transistor output current delivered to the load, said current limit means limiting the current through the drive terminal to a first amount so as to limit the series-pass voltage regulator transistor output current to a second amount.

32. A circuit for controlling a discrete series-pass voltage regulator transistor coupled between an input voltage source and a load, the circuit comprising:

an integrated circuit including:

(a) a first terminal adapted for (1) receiving an operating voltage for the integrated circuit, and (2) providing a drive signal for controlling the voltage drop across the discrete pass transistor to cause the transistor to regulate the voltage at the load to provide a regulated voltage;

(b) a second terminal adapted for monitoring the voltage at the load;

(c) a ground terminal; and (d) a control means coupled to said terminals and operable for generating the drive signal responsive to the monitored voltage to maintain the load substantially at the regulated voltage when the drive terminal operating voltage is less than the voltage at the load, wherein the drive signal limits at a saturation voltage; and a resistor coupled between the first terminal and the discrete pass transistor so that when the current flow through the discrete pass transistor reaches a first value, the voltage drop across the resistor is such that the operating voltage approaches the saturation voltage to limit the current flow through the discrete pass transistor.

33. The circuit of claim 32, wherein the resistor has a resistance greater than about 20 ohms.

34. A series-pass voltage regulator circuit adapted to be coupled between an input voltage source and a load, the circuit comprising:

a pass transistor having an emitter coupled to the input voltage source, a collector coupled to the load and a base for controlling the voltage drop across the pass transistor to provide a regulated voltage at the load, wherein the pass transistor comprises a PNP transistor;

a control circuit for monitoring the voltage at the load to generate an error signal indicative of a difference between the voltage at the load and the regulated voltage, wherein the control circuit includes:

a first input adapted for (1) receiving an operating voltage for the control circuit, and (2) monitoring the voltage at the load, and a bandgap circuit for providing a substantially temperature-stable reference voltage; and a driver for providing drive current to the base of the pass transistor, the driver being responsive to the error signal to maintain the load substantially at the regulated voltage.

35. The circuit of claim 34 wherein the control circuit comprises:

first and second PNP transistors each having an emitter coupled to the first input and a base respectively coupled together in a current-mirror configuration for providing operating current for the control circuit;

a first NPN transistor having an emitter coupled to ground and a collector commonly coupled to the collector of the first PNP transistor to form an output that generates the error signal;

a second NPN transistor having a base commonly coupled to the base of the first NPN transistor and having an emitter coupled to ground through a first resistor, said resistor having a voltage drop for regulating the currents through the first and second NPN transistors so as to maintain the monitored voltage substantially at the reference voltage; and an impedance coupled in series with the collectors of the second PNP transistor and the second NPN transistor for substantially establishing the regulation voltage of the control circuit.

36. The circuit of claim 35, wherein the circuit further comprises:

a first capacitor coupled between the collector of the first NPN transistor and the base of the first NPN transistor, the first capacitor providing a rolloff in the gain of the circuit; and a second capacitor coupled between the base of the first NPN transistor and the first input, the second capacitor providing a zero which cancels the pole generated by the first capacitor at a frequency which allows regulator loop gain to fall well below unit.

37. The circuit of claim 35 wherein the driver includes third and fourth NPN transistors each having a collector coupled to the base of the first PNP transistor wherein an emitter of the first NPN transistor drives a base of the second NPN transistor.

38. The circuit of claim 37 wherein the regulated voltage is approximately 4.9 to 5.1 volts and the pass transistor is a PNP bipolar transistor.

39. The circuit of claim 37 wherein the regulated voltage is approximately 2.7 to 3.0 volts and the pass transistor is a PNP bipolar transistor.

40. The circuit of claim 37 including bias circuit means for generating substantially constant bias currents for the circuit.

41. The circuit of claim 40 including a current limit means for limiting the pass transistor output current delivered to the load, said current limit means limiting the drive current to a first amount so as to limit the pass transistor output current to a second amount.

42. The circuit of claim 41, wherein the current limit means monitors the drive current so as to limit the current when it reaches the first amount.

* * * * *

UNITED STATES PATENT AND TRADEMARK OFFICE

CERTIFICATE OF CORRECTION

PATENT NO. : 5,274,323

DATED : December 28, 1993

INVENTOR(S) : Robert C. Parkin, et al

It is certified that error appears in the above-indentified patent and that said Letters Patent is hereby corrected as shown below:

| Column | Line | |
|---|---|---|
| 2 | 68 | After "106" insert -- ) --. |
| 3 | 10 | After "$V_{OUT}$", insert -- , --. |
| 3 | 26 | "11" should be -- 110 --. |
| 3 | 39 | "formula $R_{PL}=(V_{MIN} - 2.0V)I_{DR}$" should be -- "formula: $R_{PL} = (V_{MIN} - 2.0V)/I_{DR}$" --. |
| 12 | 36 | "unit" should be -- unity --. |

Signed and Sealed this

Eighteenth Day of April, 1995

Bruce Lehman

*Attest:*

BRUCE LEHMAN

*Commissioner of Patents and Trademarks*

*Attesting Officer*

UNITED STATES PATENT AND TRADEMARK OFFICE

CERTIFICATE OF CORRECTION

PATENT NO. : 5,274,323

DATED : Dec. 28, 1993

INVENTOR(S) : Robert C. Dobkin, et al

It is certified that error appears in the above-indentified patent and that said Letters Patent is hereby corrected as shown below:

change "Parkin" to -- Dobkin --.

| Column | Line | |
|---|---|---|
| 2 | 68 | After "106" insert -- ) --. |
| 3 | 10 | After "$V_{OUT}$", insert -- , --. |
| 3 | 26 | "11" should be -- 110 --. |
| 3 | 39 | "formula $R_{PL}=(V_{MIN} - 2.0V)I_{DR}$" should be -- "formula: $R_{PL} = (V_{MIN} - 2.0V)/I_{DR}$" --. |
| 12 | 36 | "unit" should be -- unity --. |

This certificate supersedes Certificate of Correction issued April 18, 1995.

Signed and Sealed this

Twenty-fourth Day of August, 1999

*Attest:*

Q. TODD DICKINSON

*Attesting Officer*

*Acting Commissioner of Patents and Trademarks*